United States Patent [19]

Braa et al.

[11] Patent Number: 4,676,891

[45] Date of Patent: Jun. 30, 1987

[54] PORTABLE SLUICE

[76] Inventors: Jim A. Braa, 6309 67th Pl. NE., Marysville, Wash. 98270; James W. Braa, 9408 Sharon Dr., Everett, Wash. 98204

[21] Appl. No.: 718,857

[22] Filed: Apr. 2, 1985

[51] Int. Cl.[4] ..... B03B 5/00

[52] U.S. Cl. ..... 209/458; 209/485; 209/506

[58] Field of Search ..... 209/422, 458, 459, 477, 209/483, 485, 487, 490, 506, 508, 493, 507

[56] References Cited

U.S. PATENT DOCUMENTS

| | | | |
|---|---|---|---|
| 167,133 | 8/1875 | Stephens | 209/506 X |
| 757,176 | 4/1904 | Carter | 209/458 X |
| 800,293 | 9/1905 | Hague | 209/483 |
| 2,073,122 | 3/1937 | Silke | 209/458 |
| 2,129,874 | 9/1938 | Ross | 209/506 X |
| 2,217,687 | 10/1940 | Kreher et al. | 209/490 X |
| 3,371,784 | 3/1968 | Conway | 209/493 X |
| 3,941,690 | 3/1976 | Powers et al. | 209/458 X |
| 3,970,551 | 7/1976 | Wright et al. | 209/458 |
| 4,142,965 | 3/1979 | Dolan | 209/506 X |

FOREIGN PATENT DOCUMENTS

| | | | |
|---|---|---|---|
| 0401102 | 2/1968 | Australia | 209/458 |
| 0508960 | 1/1955 | Canada | 209/458 |
| 0483817 | 10/1929 | Fed. Rep. of Germany | 209/477 |

*Primary Examiner*—Robert B. Reeves
*Assistant Examiner*—Edward M. Wacyra
*Attorney, Agent, or Firm*—Roy E. Mattern, Jr.

[57] ABSTRACT

Portable sluice equipment is provided for miners backpacking into back country to separate out valuable metals from placer deposits. All major components are made from commercially available PVC plastic conduits and fittings. The principal component is a sluice trough manufactured by first longitudinally cutting a plastic pipe in half, and then cutting spaced transverse back angled radial flow channel grooves throughout the sluice trough to initially receive the concentration of heavy metals. Also longitudinal grooves are cut throughout the length of the sluice trough near the respective top edges. Then when periodically, the main flow of sluicing water is stopped, the sluice trough is rotated about its longitudinal axis, and a minimal flow of water is directed transversely to flush the heavy metals from the transverse back angled radial flow channel grooves into the longitudinal groove. Thereafter, the heavy metal is directed downwardly, via the minimal flow of water, in the longitudinal groove and deposited in a transport container. The sluice trough entry end may be fitted with a ninety degree plastic elbow, in turn supporting a plastic catch basin. A stream water entry may be provided in this elbow to receive stream water, which enters longitudinally above the bottom of the sluice trough to impact the dropping placer deposit material. Also adjustable height spaced bias leg supports are provided, with one being located on each side of the sluice trough, to provide, in combination with a discharge end of the sluice trough, a three point support.

11 Claims, 6 Drawing Figures

PORTABLE SLUICE

BACKGROUND

As set forth in U.S. patents such as the Wrights' gold separator disclosed in their U.S. Pat. No. 3,970,551, and Mr. Powers' and Mr. Piton's portable sluice pan disclosed in their U.S. Pat. No. 3,941,690, prior sluices have been designed to be portable for packing in to the back country, and easily used and manipulated during the separation of heavy metals from placer deposits. In these patents and also as shown in: U.S. Pat. No. 644,994 concerning Mr. Milan's sluice box; U.S. Pat. No. 679,100 disclosing Mr. Allen's ore washer; U.S. Pat. No. 1,596,448 illustrating and describing Mr. Parker's extracting apparatus; and U.S. Pat. No. 1,032,281 disclosing Mr. Hawley's concentrator, previously placer deposits have been loaded onto sluices through which water is flowing, via turbulent motions, over ridges and/or grooves, often referred to as riffles. Portions of these placer deposits are carried downstream and the heavier metals separate out of the flow and become lodged in the grooves, many of which are arranged transversely to the flow of water in sluice. In Mr. Hawley's concentrator the heavier metals after being initially lodged in the grooves, are thereafter guided into a groove or gutter as the concentration process is being continued.

Even though a review of these patents indicates the ongoing many improvements in sluice equipment, there remained a need for improved sluicing equipment, which could be conveniently packed in to back country and be extremely effective in separating out heavy metals such as gold. Moreover, the improved equipment should be made out of durable, available, strong, rust-proof, and lightweight materials, which should be available at reasonable cost and easily formed and secured. The portable sluice equipment made of plastic materials, hereinafter described and illustrated, fulfills this need for improved sluicing equipment.

SUMMARY

For convenient backpacking in and out of back country placer deposits, and for very convenient operations, compact portable sluice equipment is provided, centering on utilizing a machined one half plastic tube to effectively separate out gold and other valuable minerals from placer deposits. Except for aluminum fastener assemblies, all principal components are derived from commercially available high impact PVC plastic products, and/or other strong plastic materials. Some components are machined by cutting and/or grooving, and some components are sealed at some joints using a silicon based sealing bead material. The assembled portable sluice equipment rests on a stream bed or on ground nearby a stream bed with its discharge end resting on the ground as one place of support, and with its intake end positioned above the stream bed or above the ground nearby a stream bed, by using adjustable height biased legs, serving as the other two places, of a three place or three point support. A ninety degree plastic elbow is fitted to the top end of the one half plastic tube serving as the sluice trough providing the flow channel. A plastic trapezoidal hopper to receive the placer deposit's loads is fitted to the top of the ninety degree plastic elbow. A plastic water intake opening is formed in the ninety degree plastic elbow at an elevation above the bottom of the sluice, and fitted with plastic flange pipe components, either to receive stream water directly or to receive stream water redirected from the stream via conduits, and to discharge the water in line with the one half plastic tube above its bottom. The shoveled in placer deposits falling down into the flowing stream water are carried down the sluice, encountering the turbulence and entrapments created by transverse back angled radially cut flow channel grooves, which serve in the initial separation of the varying weights of the sands and minerals resulting in the concentration of the heavy metals such as gold in these transverse grooves. After a sufficient oeprating time, the stream flow is stopped from entering the sluice. Thereafter the sluice is tilted about its longitudinal center and the heavy metals are carefully washed radially into a longitudinal collecting and guiding groove located adjacent to the high side top edge of the one half plastic tube. A like longitudinal collecting and guiding groove is optionally available adjacent to the other high side top edge of this one half plastic tube, so this sluice is alternately tiltable in the opposite radial direction, about the longitudinal axis, to direct the heavy metals into the opposite like longitudinal collecting and guiding groove. The wanted heavier metal, often gold, is guided, via water flow, throughout the balance of the length of one of these longitudinal collecting and guiding grooves, after being guided via water flow, clear of a respective transverse back angled radially cut flow channel groove. At the end of the longitudinal collecting and guiding groove, the heavy metal is directed into a container used in transporting the heavy metal out of the back country.

DESCRIPTION OF THE DRAWINGS

This portable sluice equipment manufactured from market available plastic tubes, pipes, conduits, and connectors and accessories therefore, and assembled via aluminum fasteners and silicon sealers is illustrated in the drawings, wherein.

DESCRIPTION OF THE PREFERRED EMBODIMENTS

The portable sluice equipment 10 provided for miners who backpack such equipment 10 into the back country to separate out valuable heavy metals from placer deposits is illustrated in a preferred embodiment, throughout FIGS. 1 through 6.

SETTING UP THE PORTABLE SLUICE EQUIPMENT

Figure 1:
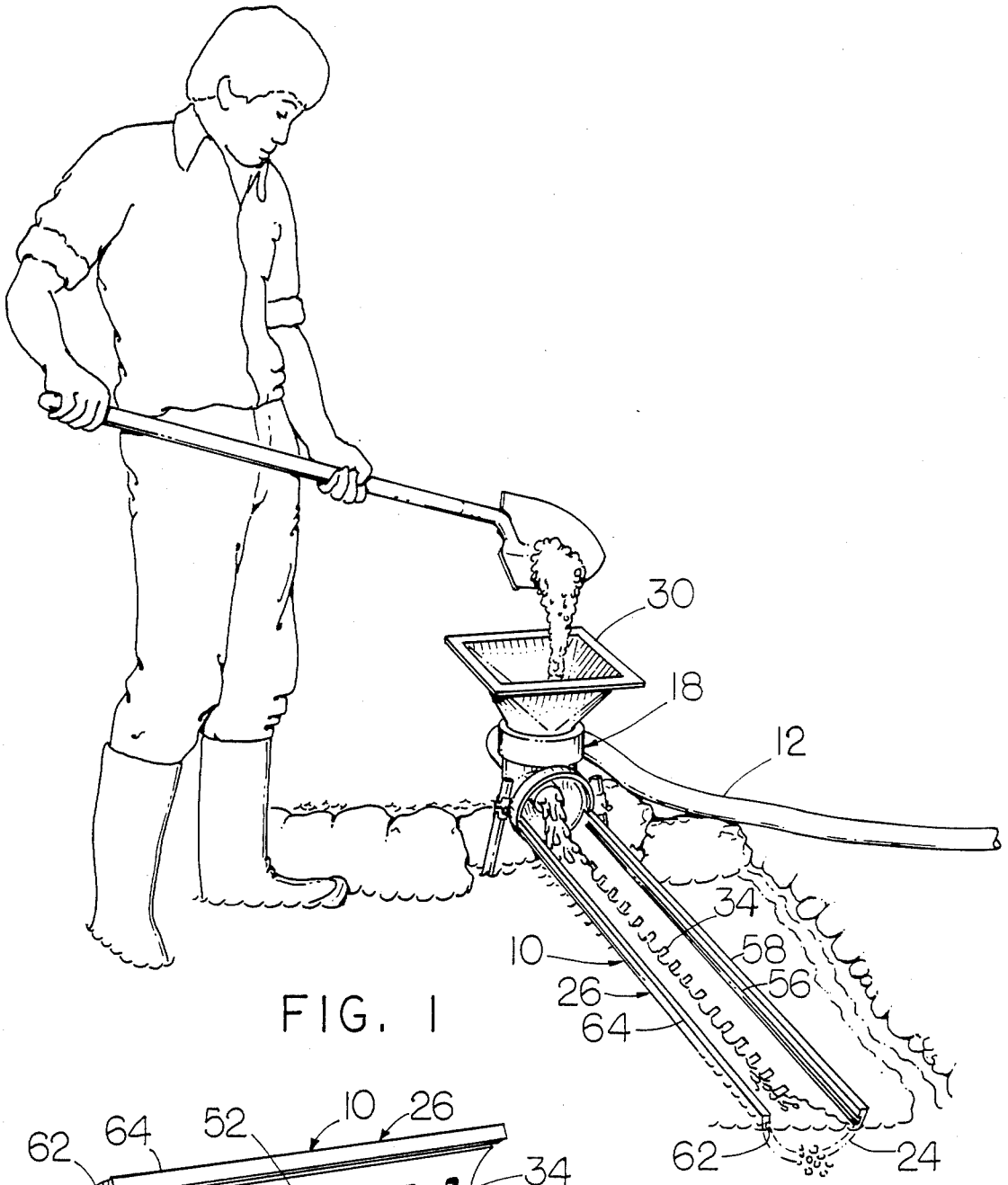
FIG. 1 is an isometric view illustrating the portable sluice equipment being utilized at a location where placer deposits are being shoveled into a hopper and then dropped into a flow of stream water, arriving in a conduit, for turbulent flow down the sluice trough, as heavy metals are separated out and concentrated in transverse back angled radially cut flow channel grooves.
Figure 4:
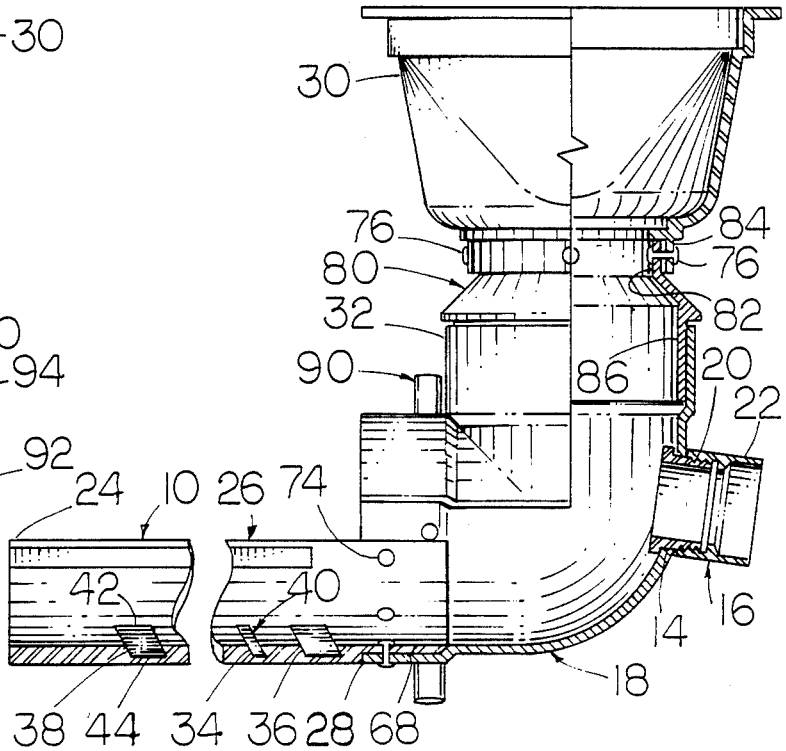
FIG. 4 is an elevational view of the portable sluice equipment, as observed from the side, with portions broken away for illustrative purposes.

As shown in FIG. 1 the miner has the portable sluice equipment 10 in operation. Stream water directed through a conduit 12 is coming from a nearby stream, not shown. The water enters through an opening 14 fitted with a two piece threaded adapter 16 secured to the ninety degree elbow 18, as shown in FIG. 4. One piece 20 is placed from inside out and the other piece 22 of the two piece threaded adapter 16 is placed from outside about the projecting portions of piece 20.

The conduit 12, shown in FIG. 1, is an accessory to be used with the sluice equipment 10, when it is either not possible to locate the portable sluice equipment in a stream or it is more convenient not to do so. When the portable sluice equipment 10 is placed in a stream, a dam is built on the sides opposite the opening 14 to direct the stream water through the opening 14. Nearby rocks may be used to position the portable sluice equipment, or adjustable height legs may be used, creating a three place or three point support in conjunction with discharge end 24 of the sluice trough 26, as shown in FIGS. 1, 3, 4, 5 and 6.

With the sluice trough 26 securely positioned in the bottom entry 28 of ninety degree elbow 18 and sloping downwardly, as shown in FIG. 1, the stream water flows essentially down the central bottom of the one half tube shaped sluice trough 26. Preferably, a hopper 30 is secured to the top entry 32 of the ninety degree elbow 18. Shovelfulls of placer deposits are dropped into the hopper, as shown in FIG. 1. The portions of such shovelfulls are impacted by the stream water and carried away, as the separation process is undertaken throughout the length of the sluice trough 26.

SEPARATING OUT THE HEAVY METALS

Figure 2:
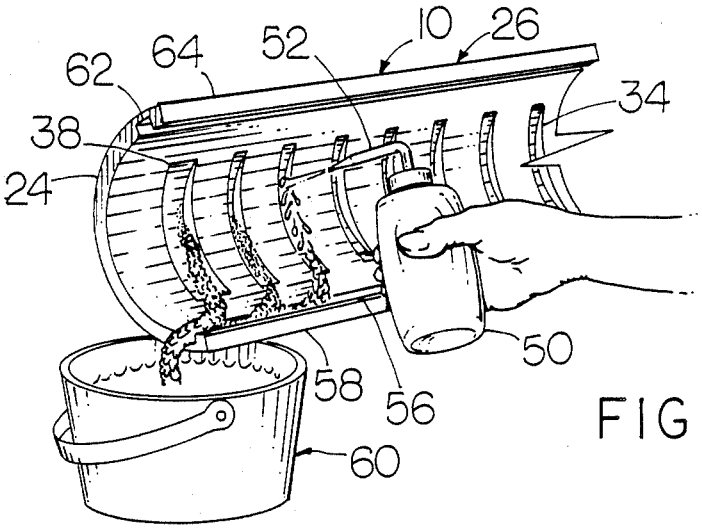
FIG. 2 is a partial isometric view indicating how periodically the flow of stream water is diverted or stopped, and the sluice trough is rotated about its longitudinal axis, and thereafter the heavy metals are carefully flushed from the transverse back angled radially cut flow channel grooves, and directed into a longitudinal groove, which in turn directs the flushed heavy metals in the controlled flushing stream, of hand applied water, to the discharge end of the sluicing trough and beyond into a container, such as a bucket, for transport out of the back country.
Figure 6:
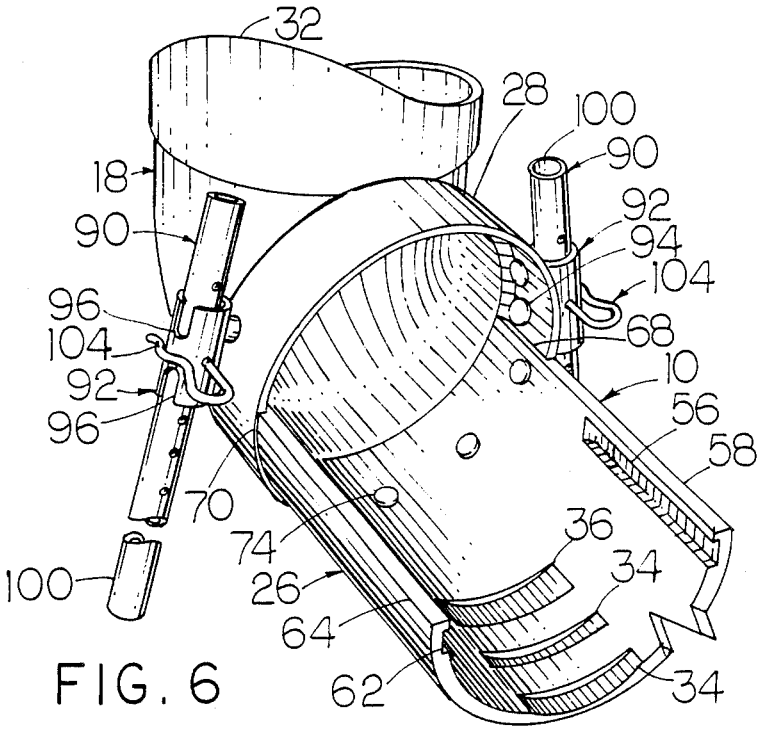
FIG. 6 is an isometric view of portions of the sluice equipment, illustrating how the supporting legs are secured and how the sluice trough is secured to the ninety degree elbow.

As shown in FIGS. 1, 2, 4 and 6, there are spaced transverse back angled radially cut flow channel grooves 34 throughout the length of the sluice trough 26. The first 36 and/or the last 38 of these grooves are larger as shown in FIG. 4, to hold the rarer larger sized heavy metals. All these grooves 34, 36 and 38 create some turbulence in the flow of the stream water. Moreover all of these grooves 34, 36, 38 receive and concentrate the heavy metals, which are protected by the overhang 40 of these grooves, as shown in FIGS. 2, 4 and 6. In respect to each groove 34, 36, 38 the entry 42 is farther downstream than the bottom 44.

RINSING OUT THE HEAVY METALS

After a sufficient operating time, the stream water is stopped. Then a smaller tube like hose, not shown, or a plastic bottle of water 50 having a nozzle 52 is used to rinse out or flush out the transverse back angled cut grooves 34, 36, 38. Preferably, as shown in FIG. 2, the portable sluice equipment 10 is rotated radially about its horizontal axis, and the heavy metals are directed down into a longitudinal groove 56 located adjacent the top edge 58 of the sluice trough 26. The heavy metals continue moving in the longitudinal groove during this flushing, rinsing, and cleaning operation, as shown in FIG. 2, until being discharged into a container 60 for transport out of the back country. If the sluice trough 26 is rotated in the opposite direction, then the heavy metals are directed into the longitudinal groove 62 located adjacent the top edge 64 of the sluice trough 26.

JOINING THE SLUICE TROUGH TO THE NINETY DEGREE ELBOW

The sluice trough 26 is reduced in outside diameter creating an overlapping portion 68 which interfits with the bottom entry 28 of the ninety degree elbow 18, as illustrated in FIGS. 4 and 6. Also a flange portion 70 is cut away at this bottom entry 28 to accommodate the overlapping portion 68.

Figure 3:
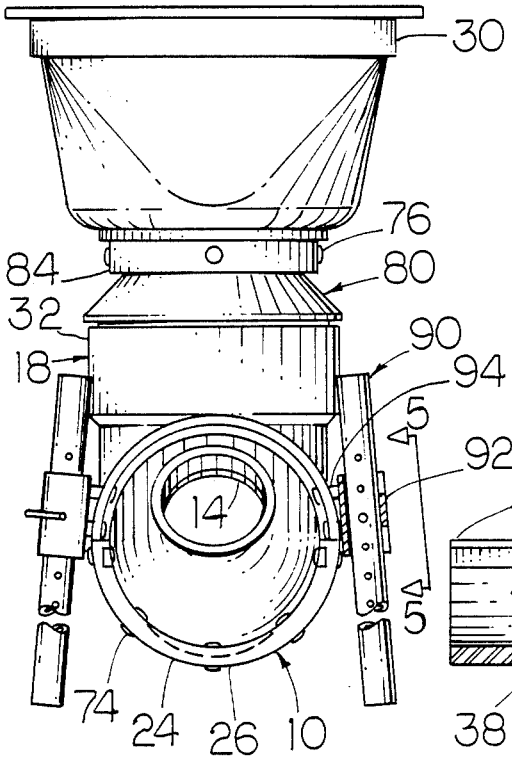
FIG. 3 is an elevational view of the portable sluice equipment, as observed from the discharge end.

Preferably, the joining of the sluice trough 26 to the elbow 18 should not disturb the flow of stream water at this locale. Before their assembly a bead of silicon sealer is placed to be between them after their assembly. Then aluminum fastening assemblies 74 are used to complete the securement of the sluice trough 26 to the ninety degree elbow 18, as shown in FIGS. 3, 4 and 6. Similar aluminum fasteners 76 are used to secure the hopper 30 to a transition member 80, having a top flange 82 to receive a bottom flange 84 on the hopper 30, and having a bottom flange 86 to be received in top entry 32 of the ninety degree elbow 18, as shown in FIGS. 3 and 4.

ADJUSTABLE LENGTH SUPPORT LEG ASSEMBLIES

Figure 5:
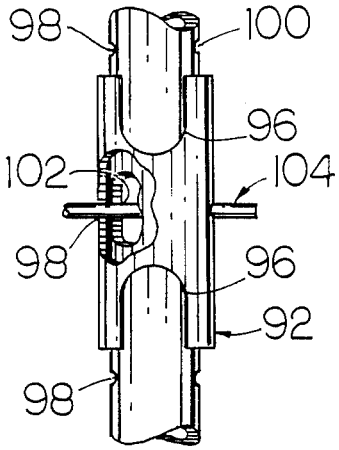
FIG. 5 is an enlarged partial view, showing how the supporting legs of the sluice equipment have their supporting heights changed to adjust to uneven terrains.

Preferably, adjustable length supporting leg assemblies 90 are used in creating the three place or three point support of the portable sluice equipment 10, with the third place being the discharge end 24 of the sluice trough 26, whereby the desired downward gravity stream water flow angle is easily established, as shown in FIGS. 1, 3, 4, 5 and 6. The slope generally established is a one inch drop per foot. At each side of the bottom entry 28 of the ninety degree elbow 18, just above the horizontal center, hollow elongated receivers 92 are secured on a bias with aluminum fastening assemblies 94. Cutouts 96 are made to accommodate tools, not shown, used in securing the fastening assemblies 94. Each hollow elongated receiver 92 has a trough hole 98, and each adjustable length leg 100 has several spaced through holes 102. When the wanted effective supporting height of a respective adjustable length leg 100 is determined, then the closest pair of through holes 98 and 102 are aligned. Through these aligned holes 98 and 102, a strong clip pin 104 is inserted to take the shear load, as shown in FIGS. 5 and 6.

USE OF COMMERCIALLY AVAILABLE PRODUCTS

As viewed throughout the figures of the drawings, commercially available products are recognizable. The sluice trough 26, often referred to as the sluice tube, is made by longitudinally cutting a plastic tube, pipe or conduit into two halves. In the preferred embodiment the sluice trough 26 is made of high impact PVC plastic material, which eliminates the rust problem otherwise associated with metal sluice troughs. Moreover, the preferred length of five feet of the preferred sluice trough 26 is comparatively lightweight at eighteen and one half pounds, making it easy to backpack in. For working areas accessible to vehicles, sluice troughs up to ten feet long are used, and comparatively they are still considered light weight, especially in reference to wood sluice boxes, which become heavier during their use, via water absorption.

The ninety degree elbow 18, is initially a standard available plastic part, as is the transistion member 80, which is known as a reducer, to accommodate the changes in the interior diameters of the passageways. The two piece threaded adapter 16 originally is derived from standard available plastic parts. The hopper 30 is derived from a standard plastic catch basin. The adjustable length supporting leg assemblies are made from standard plastic tube parts and secured with available aluminum fastening assemblies and the standard clip pin 104. Comparatively, the entire assembly of the portable sluice equipment 10 is light weight, in reference to wood or metal, or combinations of other materials. The plastic and aluminum materials insure a long period of use for this portable sluice equipment.

EFFECTIVE OPERATIONS ARE UNDERTAKEN USING THIS PORTABLE SLUICE TUBE EQUIPMENT

This portable sluice tube equipment 10 is quickly and conveniently arranged for transport by vehicle to a starting place of a backpack trip. It is then relativey easily carried into the back country. Once a placer mining location is reached, the portable sluice equipment 10 is quickly set up and ready for operation. During an operating day, many cycles of separating the heavy metals form placer deposits are conveniently undertaken, via the efficient use of stream water directed throughout the central bottom volume of the sluice trough 26, shaped as a one half round tube, which it is, followed by the efficient use of limited quantities of water to rinse the heavy metals into a container during each cycle, as illustrated in FIGS. 1 and 2.

We claim:

1. A portable sluice manufactured principally from market available plastic components, and conveniently backpackable into the back country where placer deposits are available, to separate valuable heavy material from placer deposits comprising:

an elongated sluice trough which is a one half longitudinal section of a thick walled plastic pipe having an entry end and a discharge end to define a flow channel having top edges;

said trough having longitudinally spaced, transverse radial grooves arranged in the longitudinally directed flow channel, said radial grooves being back angled relative to material movement in the flow channel; and said trough further having at least one substantially full length longitudinal groove adjacent a respective top edge;

whereby, after a sluicing operational period, when placer deposits and stream water have been entered at the entry end of the sluice trough and directed throughout the length of the sluice trough, then the stream water flow through the sluice trough is stopped, and thereafter, the sluice trough is radially rotated, about its longitudinal axis, substantially through eighty degrees, lowering the at least one substantially full length longitudinal groove;

then a controlled flushing is undertaken, using a limited flow of water to transversely rinse the heavy minerals out of the spaced, transverse, back angled radial grooves and into the at least one substantially full length longitudinal groove;

thereafter, the heavy minerals are controllably flushed throughout the at least one substantially full length longitudinal groove for discharge into a container, for their transport out of the back country.

2. A portable sluice, as claimed in claim 1, wherein the longitudinally spaced, transverse, back angled, radial grooves result from cutting with a rotating radial cutter positioned at a thirty degree angle in reference to a vertical plane, which is perpendicular to the longitudinal centerline of the sluice trough;

whereby, the bottom of these transverse, back angled, radial grooves arranged at this thirty degree angle, are located closer to the entry end of the sluice trough, than are the top entries of these transverse, back angled, radial grooves, and whereby, these transverse, back angled, radial grooves are deeper at the bottom longitudinal centerline of the sluice trough, and then they become gradually shallower, as they transversely extend in either radial direction from this bottom longitudinal centerline, yet they fully remain within the thick wall of this one half longitudinal section of a plastic pipe, so there is no leakage through the thick wall of this one half longitudinal section of plastic pipe.

3. A portable sluice, as claimed in claim 2, wherein the sluice trough has a second substantially full length longitudinal groove adjacent the other, opposite, top edge of the sluice trough for enabling the sluice trough to be radially tilted in either direction about its longitudinal axis.

4. A portable sluice, as claimed in claim 3, including a ninety degree elbow having one end fitted to the entry end of the sluice trough and the other end extending upwards.

5. A portable sluice, as claimed in claim 4, wherein the ninety degree elbow has a stream water entry located at an elevation higher than the flow channel of the sluice trough at said entry end, to receive stream water, which enters longitudinally above the flow channel of the sluice trough at the entry end, to impact the placer deposit material.

6. A portable sluice, as claimed in claim 5, having a hopper fitted to the other end of the ninety degree elbow.

7. A portable sluice as claimed in claim 6, having a transition fitting used in fitting the hopper to the ninety degree elbow, whereby the hopper then used is in the form of a catch basin.

8. A portable sluice, as claimed in claim 6, wherein the ninety degree elbow has hollow elongated plastic receivers secured on each side, and depending plastic support legs are secured in these receivers, to hold the assembled ninety degree elbow and the entry end of the sluice trough at a higher elevation than the discharge end of the sluice trough, in a three place supporting arrangement, and both the depending plastic support legs and the hollow elongated plastic receivers for them, have through holes to receive a removable clip pin which secures them together, and said support legs have a plurality of spaced through holes for use in setting the respective effective supporting heights of said support legs, when positioning said sluice on uneven terrain.

9. A portable sluice, as claimed in claim 8, wherein the ninety degree elbow at said one end has a recess to receive the entry end of the sluice trough, whereby the inside entry surface of the sluice trough and the adjacent inside surface of the ninety degree elbow have the same radius, thereby insuring an even flow of said stream water from the ninety degree elbow into the sluice trough.

10. A portable sluice, as claimed in claim 9, wherein a bead of silicon sealant is used in the recess of the ninety degree elbow creating a seal between the ninety degree elbow and the sluice trough.

11. A portable sluice, as claimed in claim 10, wherein spaced aluminum fastening assemblies are used in securing the sluice trough to the ninety degree elbow.

* * * * *